US007730935B1

(12) United States Patent
Bujak, Jr.

(10) Patent No.: US 7,730,935 B1
(45) **Date of Patent: *Jun. 8, 2010**

(54) HYDRONIC SYSTEM CONTROL FOR HEATING AND COOLING

(75) Inventor: Walter E. Bujak, Jr., Suffield, CT (US)

(73) Assignee: Carrier Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/472,619

(22) Filed: Dec. 27, 1999

(51) Int. Cl.
*F24F 3/06* (2006.01)

(52) U.S. Cl. ..... 165/208; 165/209; 165/50; 165/218; 236/1 B; 236/1 C; 236/49.3; 236/91 F; 236/91 G; 62/158; 62/201

(58) Field of Classification Search ..... 165/208, 165/209, 50, 218; 236/1 B, 1 C, 49.3, 91 F, 236/91 G; 62/158, 201
See application file for complete search history.

(56) References Cited

U.S. PATENT DOCUMENTS

| | | | | |
|---|---|---|---|---|
| 3,305,001 A | | 2/1967 | Haufler et al. | |
| 3,384,155 A | * | 5/1968 | Newton | 165/208 |
| 3,724,534 A | * | 4/1973 | Weatherston | 165/208 |
| 4,890,666 A | * | 1/1990 | Clark | 165/208 |
| 5,207,070 A | | 5/1993 | Miyazaki | 62/160 |
| 5,245,835 A | | 9/1993 | Cohen et al. | 62/159 |
| 5,261,483 A | * | 11/1993 | Imaoka | 165/219 |
| 5,303,767 A | * | 4/1994 | Riley | 165/208 |
| 6,298,677 B1 | * | 10/2001 | Bujak, Jr. | 165/208 |

FOREIGN PATENT DOCUMENTS

| | | | |
|---|---|---|---|
| EP | 1113231 A2 | * | 7/2001 |
| JP | 60-108634 A | | 6/1985 |
| WO | 96/05473 A | | 2/1996 |

* cited by examiner

*Primary Examiner*—John K Ford
(74) *Attorney, Agent, or Firm*—Miller, Matthias & Hull

(57) ABSTRACT

A control system for controlling delivery of either heated or cooled water over a common water line to a plurality of heat exchangers. The control system includes a hydronic system controller which polls the heating or cooling demands of zone controllers controlling the respective delivery of water to the individual heat exchangers. The hydronic system controller is operative to implement a changeover between delivery of heated water to delivery cooled water or vice versa. The implemented changeover preferably includes checking the temperature of the water being returned to the source or sources for heating or cooling the water as well as defining a changeover time period which must occur in the event that the temperature of the water in the return line is not within a predefined range.

15 Claims, 4 Drawing Sheets

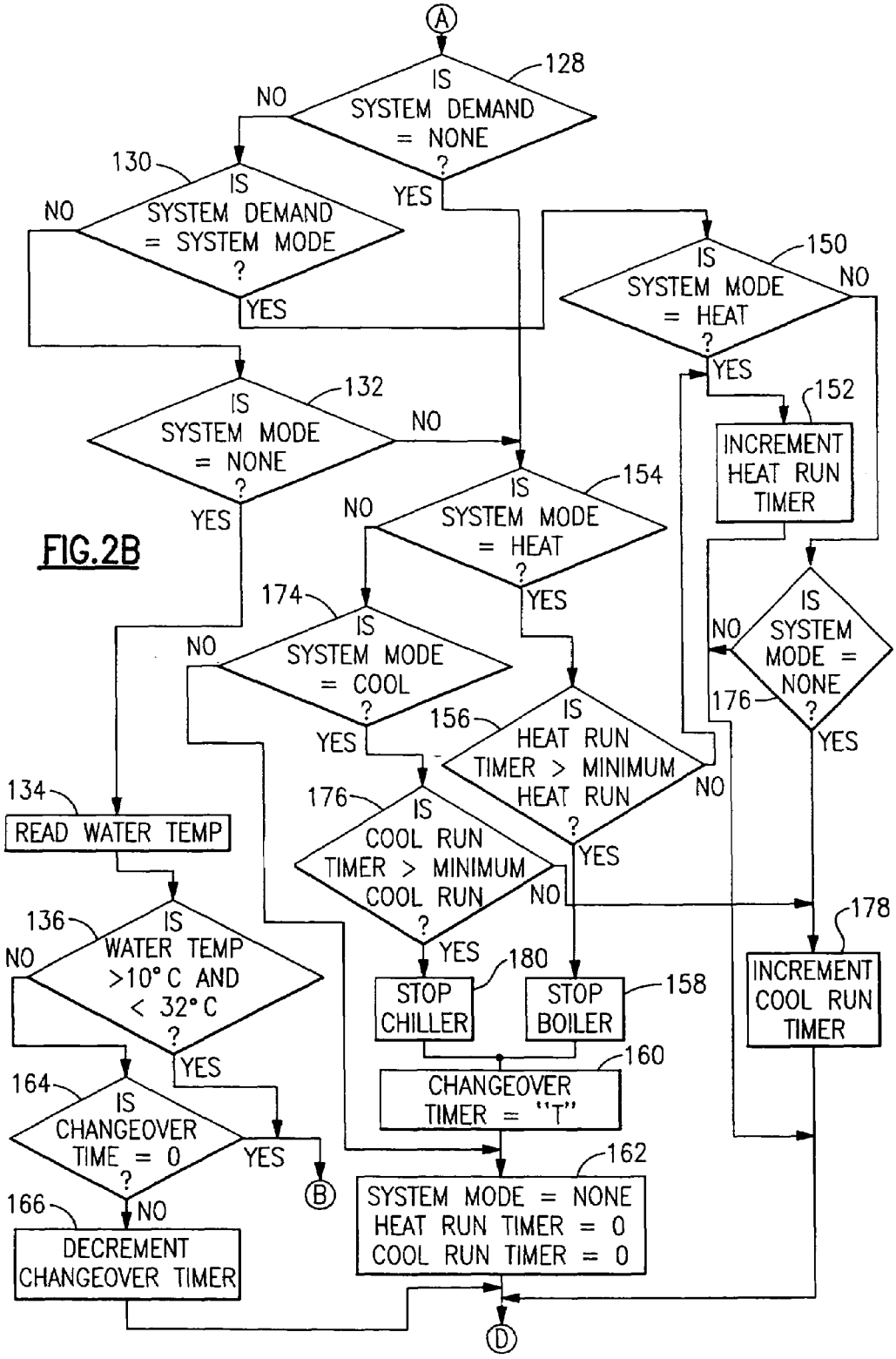
A
128
IS SYSTEM DEMAND = NONE ?
NO
YES
130
IS SYSTEM DEMAND = SYSTEM MODE ?
NO
YES
150
IS SYSTEM MODE = HEAT ?
NO
YES
152
INCREMENT HEAT RUN TIMER
132
IS SYSTEM MODE = NONE ?
NO
YES
154
IS SYSTEM MODE = HEAT ?
NO
YES
FIG.2B
174
IS SYSTEM MODE = COOL ?
NO
YES
156
IS HEAT RUN TIMER > MINIMUM HEAT RUN ?
NO
YES
IS SYSTEM MODE = NONE ?
NO
176
YES
134
READ WATER TEMP
176
IS COOL RUN TIMER > MINIMUM COOL RUN ?
NO
YES
178
INCREMENT COOL RUN TIMER
136
IS WATER TEMP >10° C AND < 32° C ?
NO
YES
180
STOP CHILLER
STOP BOILER
158
160
CHANGEOVER TIMER = "T"
164
IS CHANGEOVER TIME = 0 ?
YES
NO
B
162
SYSTEM MODE = NONE
HEAT RUN TIMER = 0
COOL RUN TIMER = 0
166
DECREMENT CHANGEOVER TIMER
D

HYDRONIC SYSTEM CONTROL FOR HEATING AND COOLING

BACKGROUND OF THE INVENTION

This invention relates to systems for adding or removing heat from a confined space in order to control the temperature in that space. In particular, this invention relates to hydronic systems which employ water as the heat exchange medium for adding or removing heat from a confined space.

Hydronic systems may employ different approaches as to how to deliver water to spaces that are to be heated or cooled. For instance, hydronic systems may use a first conduit to deliver heated water and a second conduit to deliver cooled water to one or more heat exchangers servicing the spaces to be heated or cooled. These systems will also use separate return conduits to circulate the water back to the heating and cooling sources which heat or cool the water before it is again delivered to the one or more heat exchangers. The above described hydronic systems are often referred to as "four pipe" hydronic systems because there are two delivery conduits or pipes which deliver the water to the one or more heat exchangers and two return conduits or pipes which circulate water back to the heating and cooling sources.

Another type of hydronic system uses a single conduit to deliver either heated or cooled water from the heating or cooling sources to the one or more heat exchangers in the spaces to be heated or cooled. This type of hydronic system will also use a single return conduit to circulate the water from the one or more heat exchangers back to the heating and cooling sources. This latter type of hydronic system is typically referred to as a "two-pipe" system because the one or more heat exchangers have one common supply conduit or pipe and one common return conduit or pipe.

The above-described two-pipe hydronic system provides a flow of water to the various heat exchangers at an appreciably lower cost in terms of piping versus the "four-pipe" hydronic system. However the two pipe system cannot easily change from circulating heated water to circulating cooled water to the heat exchangers. In this regard, the cooling source which could be a chiller does not perform well when it is receiving substantially warm water in the return line as a result of the two pipe system having previously been in a heating mode. The same is true for a boiler that is receiving substantially cooler water than it normally is deigned to operate with.

The inability to changeover or switch the two-pipe hydronic system between heating and cooling or vice versa has previously led to switching the system to either heating or cooling, depending on the season of the year. For instance, changeovers would be implemented on particular calendar dates indicating normal change of seasonal weather conditions. On the other hand, a changeover might be implemented depending on a separately sensed outdoor air temperature indicating whether the two-pipe hydronic system should be in either heating or cooling for the day. The above described changeover controls do not allow a hydronic system to respond to heating or cooling demands that may change throughout the day. The above described systems moreover do not respond to different demands for cooling or heating throughout a building on a given day.

OBJECTS OF THE INVENTION

It is an object of this invention to provide a two-pipe hydronic system with the capability to automatically change from one operating mode to another operating mode at any time regardless of outdoor air temperature or calendar date.

It is another object of this invention to provide a two-pipe hydronic system that will be responsive to different demands for cooling or heating throughout a building on a given day.

SUMMARY OF THE INVENTION

The above and other objects are achieved by providing a two-pipe hydronic system with control logic, which continually polls the spaces or zones in which heating or cooling may be demanded so as to determine whether there is a predominance of either heating or cooling being demanded. The polling also checks to see whether a determined predominance of demand for either heating or cooling meets certain minimum demand requirements. In the event that minimum demand requirements are met, then a system demand is set reflecting the polling results. For instance, the system demand would be set for heated water if the predominance of polled spaces reflected that more spaces requested heating than requested cooling and that the number of spaces requesting heating exceeded some minimum number of spaces required to implement a changeover from cooling to heating. The system demand does not, however, allow for an immediate changeover to heating in the event that a changeover to heating is being requested by the polling results. In particular, the system will first check to see whether the current mode of operation has run for a minimum time period before stopping the then active heating or cooling equipment. When the minimum time period has expired and the particular active equipment has been stopped, the control will preferably inquire as to whether a particular water temperature in the return line is within a range of temperatures. The system may also inquire as to whether a particular period of time has elapsed since the previously activated equipment was turned off. It is only after the return water temperature is within range or the period of time since turning off the previously activated equipment has elapsed, if the latter is required, that the control logic will proceed to actually authorize the start up of the particular heating or cooling equipment pursuant to the request of the polling results.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
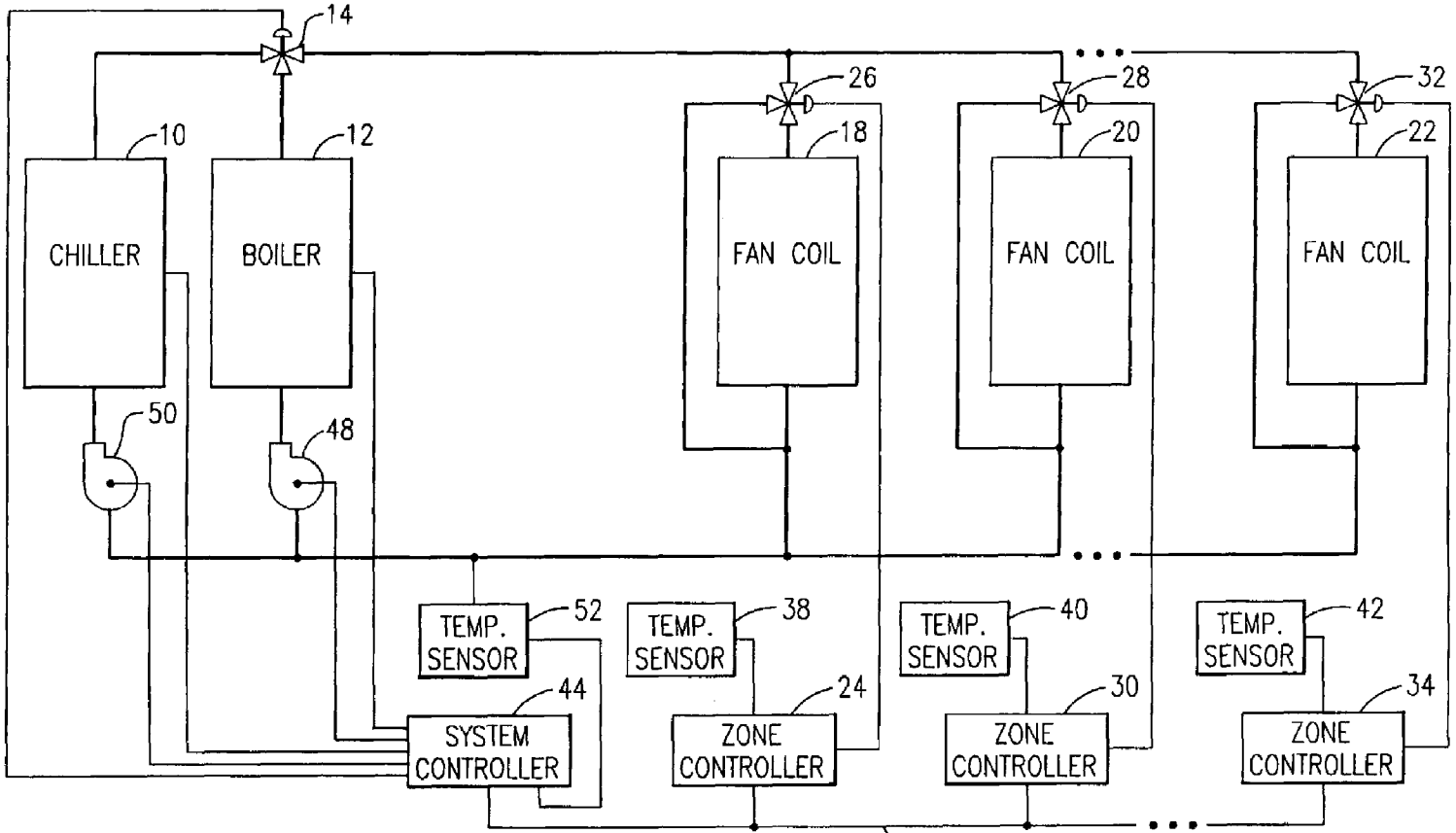
FIG. 1 is a schematic view of a two-pipe hydronic system having both a chiller and a boiler for delivering cooled or heated water to heat exchangers and a system controller and a series of zone controllers associated therewith.

Referring now to FIG. 1, a two-pipe hydronic system is seen to include a chiller 10 and a boiler 12. Hot water from the boiler 12 may flow through a two-position changeover valve 14 to fan coil heat exchanger 18, 20 and 22. Alternatively, the chiller 10 may provide chilled water to the fan coil heat exchangers 18, 20 and 22 via the two position valve 14. It is to be understood that each fan coil heat exchanger may use the delivered water to condition air in a space that is to be heated or cooled. This is often referred to as a "zone of heating or cooling". Water from either the chiller 10 or the boiler 12 flows through the fan coil heat exchanger 18 in the event that a zone controller 24 authorizes such a flow by positioning of a control valve 26. The zone controller 24 may also divert any water flow around the fan coil heat exchanger 18 by a further positioning of the control valve 26. It is to be appreciated that the fan coil heat exchanger 20 operates in a similar fashion in response to the positioning of a control valve 28 under the control of a zone controller 30. It is furthermore to be appreciated that the last fan coil heat exchanger 22 in the hydronic system will also be controlled by the positioning of a control valve 32 under the control of a zone controller 34. Water flow to each heat exchanger within each corresponding fan coil can either fully bypass the heat exchanger, fully flow through the heat exchanger, or partially flow through the heat exchanger and bypass. The control valve position is determined by the zone controller and is a function of the zone's heating or cooling requirement and the operating mode of the water loop. Each zone controller 24, 30 and 34 is also connected to a corresponding temperature sensor such as 38, 40 and 42, which senses the temperature in the respective zone serviced by the fan coil heat exchanger and provides such temperature information to the respective zone controller. Each zone controller will furthermore have a stored setpoint value for the particular zone. This may be a temperature that is arbitrarily defined by an individual either through a programmable thermostat or other device suitable for entering setpoint information. Each zone controller will either have a demand for heat or a demand for cooling or essentially a demand for neither heating or cooling depending on the sensed temperature in the zone versus the zone's stored setpoint.

Each individual zone demand is provided to a system controller 44 via a bus 46. The system controller 44 controls pumps 48 and 50 so as to thereby pump return water from the heat exchangers 18, 20 and 22 into a respective boiler 12 or chiller 10. It is to be appreciated that only one of the two pumps 48 or 50 will be activated at any time by the system controller 44 so as to thereby protect the boiler or chiller from unnecessary exposure to return water not having the proper temperature range for the operation of the respective equipment. In order to assure that the proper temperature range is present in the return line, a temperature sensor 52 senses the return water temperature and provides the same to the system controller 44.

Figure 2A:
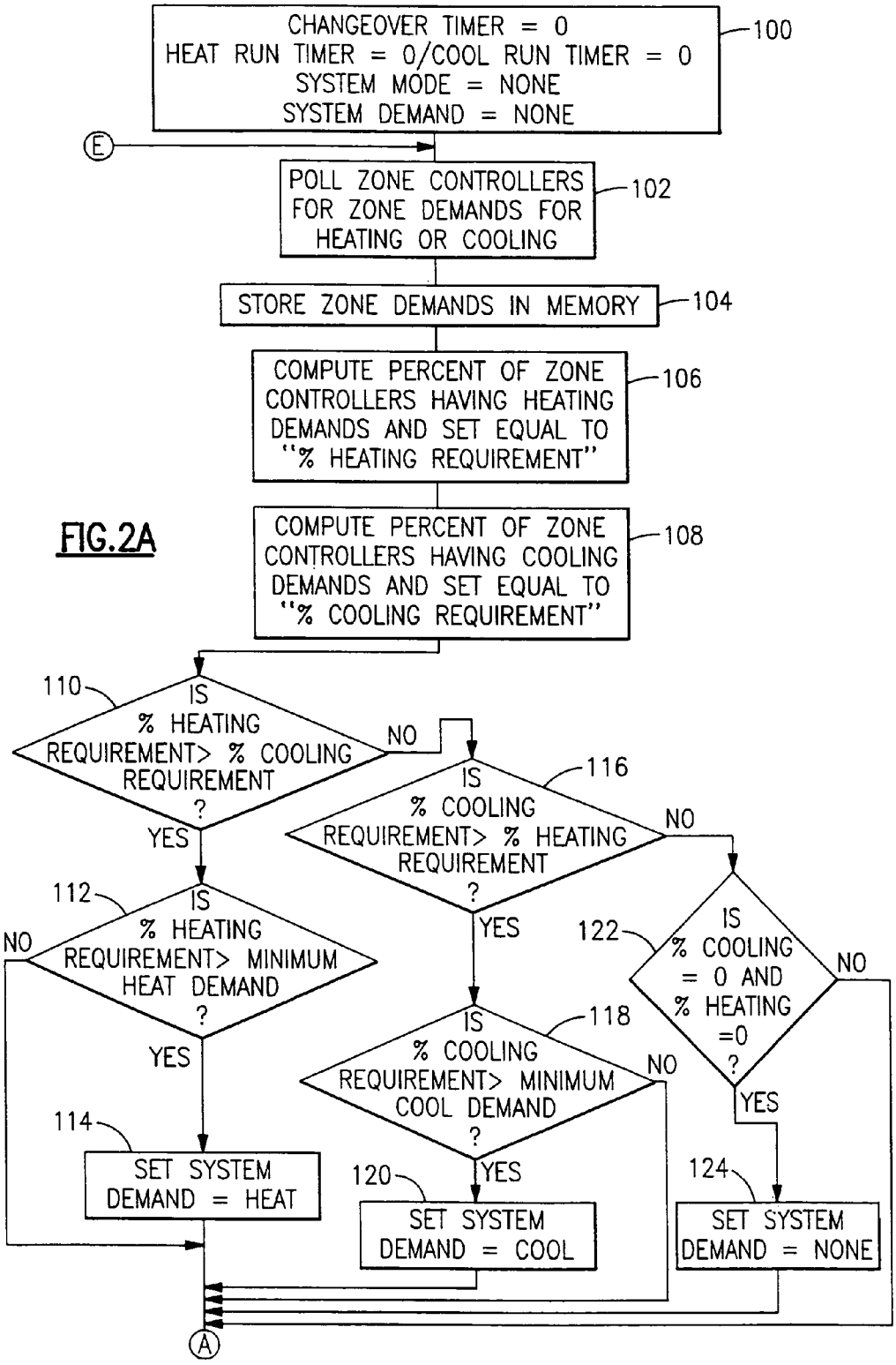
FIG. 2 is a flow chart of the method used by the system controller within FIG. 1 so as to control the activation or deactivation of the chiller or the boiler of FIG. 1.
Figure 2C:
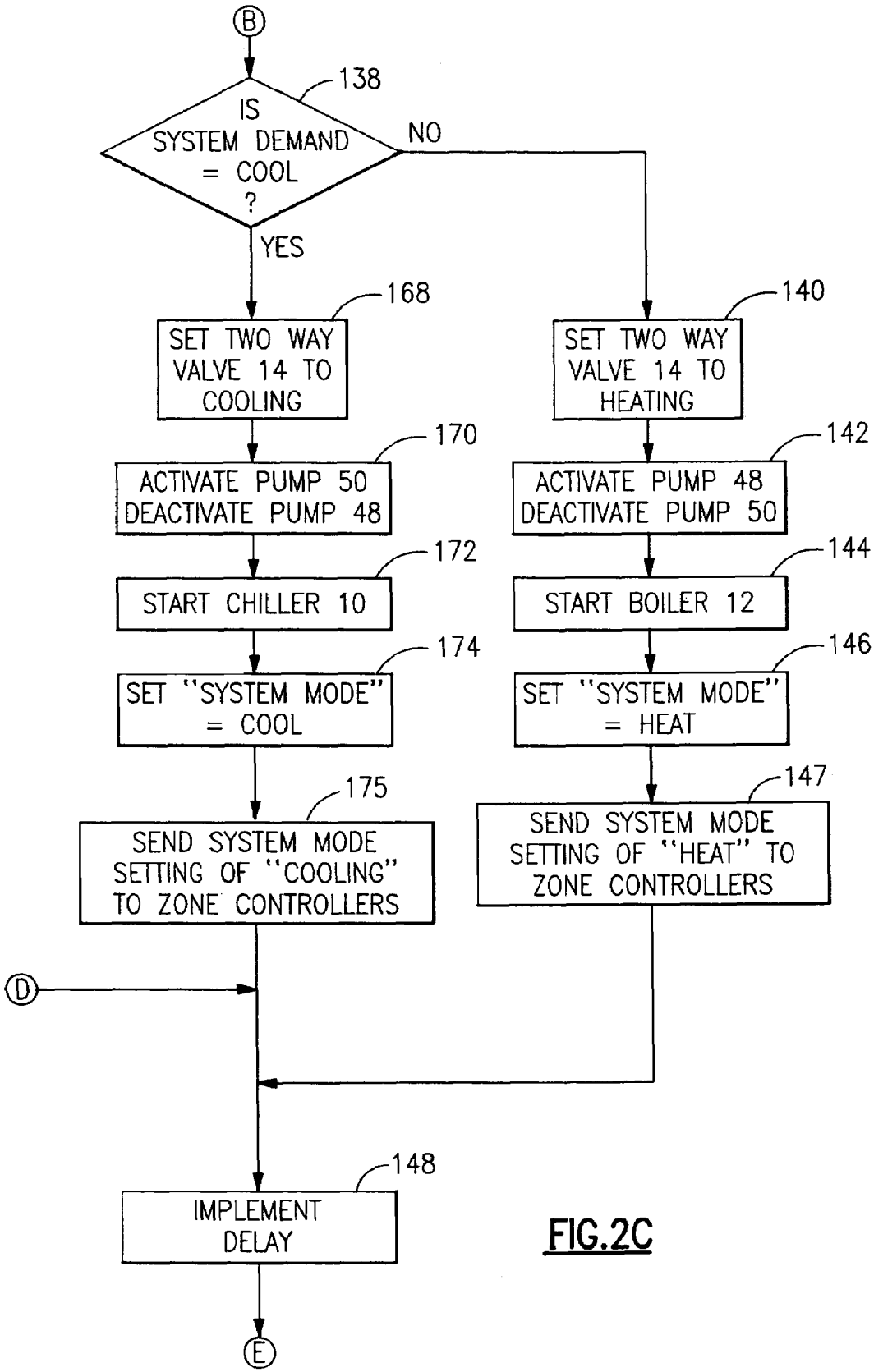

Referring now to FIGS. 2A, 2B, and 2C, a process utilized by a programmable microprocessor within the system controller 44 is illustrated. The process begins with an initialization step 100, which sets the initial values of the following variables: "changeover timer", "heat run timer", "cool run timer", "system demand" and "system mode". The microprocessor within the system controller 44 will proceed to a step 102 and poll each of the zone controllers for their respective zone demands for heating or cooling. It is to be appreciated that this is preferably done by addressing each zone controller 24, 30 and 34 via the bus 46 and requesting the specific zone demand of the zone controller. The zone demand will of course be a function of the difference between setpoint and sensed temperature in the respective zone. The zone demands are stored in a memory associated with the microprocessor within the system controller 44 in a step 104. The microprocessor proceeds to a step 106 and computes the percentage of the polled zone controllers that have heating demands. This is preferably done by first adding up the number of zone controllers having a heating demand and dividing this number by the total number of zone controllers present within the hydronic system. The results are stored as "percent heating requirement". The microprocessor within the system controller proceeds to a step 108 and computes the percentage of zone controllers having cooling demands in a similar fashion. In other words, the microprocessor first adds up the number of zone controllers having cooling demands and divides this number by the total number of zone controllers in the hydronic system and stores the result as "percent cooling requirement".

The microprocessor proceeds to a step 110 and inquires whether the percent heating requirement computed in step 106 is greater than the percent cooling requirement computed in step 108. The microprocessor within the system controller 44 will proceed to step 112 in the event that the percent heating requirement exceeds the percent cooling requirement. Referring to step 112, the processor will inquire as to whether the percent heating requirement computed in step 106 is greater than a "minimum heat demand". The minimum heat demand is preferably a stored percentage value in the memory associated with the microprocessor. This percentage value should be slightly less than the percentage of zone controllers that must be demanding heat in the system of FIG. 1 in order for the system to change over to providing heated water. When this percentage is exceeded, the microprocessor within the system controller will proceed in a step 114 to set "system demand" equal to heat.

Referring again to step 110, in the event that the percent heating requirement does not exceed the percent cooling requirement, the processor proceeds to a step 116 and inquires as to whether percent cooling requirement is greater than percent heating requirement. In the event that the answer is yes, the processor will proceed to a step 118 and inquire as to whether the percent cooling requirement is greater than a minimum cooling demand for the hydronic system of FIG. 1. This minimum cooling demand will be slightly less than the percentage of zone controllers that must be demanding cooling in order to have the processor proceed in a step 120 to set system demand equal to cool.

Referring again to step 116, in the event that the percent cooling requirement is not greater than the percent heating requirement, then the processor will proceed to a step 122 and determine if both the percent cooling and the percent heating equal zero. If both are equal and zero, the processor will proceed to set the "system demand" equal to none in a step 124. In the event that both demands are not equal to zero in step 122, then the processor will proceed directly to a step 128.

Referring to step 128, it is to be appreciated that the processor will have proceeded from either step 114, step 120 or step 124 to this step with a particular setting of system demand. The processor will also have proceeded to this step from step 122 without changing the present system demand established previously. For instance, if the "system demand" is "none" as a result of its initial setting in step 100, then it will continue to be so after exiting step 122 along the "no" path. If on the other hand, the "system demand" were previously set in a prior execution of the logic, then that would be the system demand setting after exiting step 122 along the "no path".

It is noted that the processor inquires as to whether the system demand equals none in step 128. Assuming the system demand is heat as a result of step 114, the processor will proceed along the no path out of step 128 to a step 130 and inquire as to whether the value of system demand equals the value of "system mode". Since the processor will be operating immediately after initialization, the system mode value will be none prompting the processor to proceed along the no path to a step 132.

Referring to step 132, the processor will inquire whether the value of system mode is equal to none. Since system mode will be equal to none initially, the processor will proceed along the yes path to a step 134 and read the water temperature from sensor 52 in the return line of the hydronic system. The processor proceeds in a step 136 to inquire as to whether the water temperature read in step 134 is greater than ten degrees Centigrade and less than thirty-two degrees Centigrade. Since the hydronic system is not recovering from any previous heating or cooling mode of operation, the water temperature in the return line should be within this range of temperatures. This will prompt the processor to proceed along the yes path to a step 138 wherein inquiry is made as to whether system demand is equal to cool. Since the system demand was set equal to heat in step 114, the processor will proceed out of step 138 along the no path to a step 140 and set the two way valve 14 to heating. The processor will activate pump 48 and deactivate pump 50 in a step 142 before proceeding to step 144 wherein the boiler 12 is activated.

The processor proceeds to set "system mode" equal to heat in a step 146. The processor will proceed from step 146 to a step 147 and send the system mode setting of "heat' to the zone controllers 24, 30, and 34. Each zone controller will use the communicated setting to determine how to position its control valve. In this regard, if the local demand is for heating, then the control valve will be positioned by the zone controller so as to deliver hot water from the boiler to the fan coil heat exchanger. If the local demand is however for cooling, then the hot water from the boiler will bypass the fan coil heat exchanger. It is to be appreciated that the above assumes that the local zone controller is not able to independently determine whether the water being delivered is hot or cold. In the event that the zone controllers possess the capability of independently determining the temperature of the water being delivered, then they will implement the positioning of their respective control valves without the need to receive the system mode setting from the system controller 44.

The processor will proceed from step 147 to a step 148 wherein a predefined time delay will be implemented before returning to step 102. It is to be appreciated that the amount of time delay will be an arbitrary timed amount for a given hydronic system so as to delay the system controller before it again polls the zone controllers in step 102.

Referring again to steps 102-124, the processor within the system controller will poll the zone controllers and thereafter compute the percentages of zone controllers having heat demands and the percentage of zone controllers having cooling demands before again determining whether or not the percentage heating requirement is greater than the percentage cooling requirement in a step 110. Assuming that the zone controllers continue to have essentially the same demands, then the percent heating requirement will continue to exceed the percent cooling requirement so as to thereby prompt the processor to proceed from step 110 to step 112 and again inquire as to whether the minimum heat demand has been exceeded before again setting the system demand equal to heat in step 114. The processor will proceed to step 128 and again inquire as to whether the system demand is equal to none. Since the system demand will be equal to heat, the processor will proceed to step 130 and inquire as to whether system demand equals system mode. Since system mode will now be equal to heat, the processor will proceed along the yes path to a step 150 and inquire as to whether system mode equals heat. Since system mode will be equal to heat, the processor will proceed to a step 152 and increment a "heat run timer". The heat run timer will be incremented for the first time since the heat run timer was initially set equal to zero. It is to be appreciated that the amount by which the heat timer will be incremented will preferably be the same as the amount of delay set forth in step 146 between successive executions of the control logic. The processor will proceed from step 152 to step 148 wherein the delay will be again implemented before returning to step 102.

It is to be appreciated that the processor within the system controller will continue to execute the control logic in the manner that has been previously discussed until there has been a change in the demands of the zone controllers so as to cause a change in the percentage heating requirement and percentage cooling requirements as computed in steps 106 and 108. Assuming that the results produce a higher cooling requirement than heating requirement, then the processor will proceed out of step 110 to step 116 and hence to step 118 since the percentage cooling requirement will now exceed the percentage heating requirement. This will prompt the processor to inquire as to whether the percentage cooling requirement is greater than the minimum cooling demand required in step 118. Assuming that the minimum cooling demand percentage has been met, the processor will proceed to set system demand equal to cool in step 120. It is hence to be appreciated that the polling logic of steps 102 through 124 will have recognized a change in the zone controller demands sufficient to prompt the change of system demand from heat to cool.

The processor proceeds from step 120 to a step 128 and inquires as to whether system demand equals none. Since system demand will now be equal to cool, the processor will proceed along the no path to step 130 and inquire as to whether system demand still equals the value of system mode. Since system demand will have changed from heat to cool, the processor will proceed along the no path to step 132 and inquire as to whether system mode equals none. Since system mode will still be equal to heat, the processor will proceed along the no path to a step 154 and inquire as to whether system mode equals heat. Since system mode will still be equal to heat, the processor will proceed to a step 156 and inquire as to whether heat run timer is greater than minimum heat run. It will be remembered that the heat run timer will have been successively incremented in step 152 each time the processor within the system controller executes the control logic of FIG. 2. Assuming that the hydronic system has been in a heating mode of operation for a considerable period of time, the heat run timer will normally exceed any minimum amount of time established for a heat run of the hydronic system of FIG. 1. It is to be appreciated that this particular time value for minimum heat run will be stored in memory for use by the processor within the system controller. Assuming that the heat run timer has exceeded this minimum heat run value, the processor will proceed to a step 158 and stop the operation of the boiler 12. It is to be appreciated that this may be a signal from the system controller to the burner control within the boiler 12.

The processor will proceed from step 158 to a step 160 and set the changeover timer. The change over timer will be set equal to a predetermined changeover time period, "T" that the hydronic system of FIG. 1 must experience before it can be switched from heating to cooling or vice versa. This changeover time period will have been stored in memory associated with the processor. The processor will proceed in a step 162 to set system mode equal to none and both heat run timer and cool run timer equal to zero. The processor will then proceed to step 148 and again implement the prescribed amount of delay before the next execution of the control logic.

At such time as the next execution occurs, the processor will again poll the zone controllers in a step 102 and compute the percentage heat requirement and cooling requirement in steps 106 and 108. Assuming that the percentage cooling requirement continues to now exceed percentage heating requirement, the processor will again execute steps 110, and 116 through 120 and again set the system demand equal to cool. This will prompt the processor to proceed through step 128 to step 130 since system demand will be equal to cool. Since system demand will not equal system mode at this time, the processor will proceed along the no path to step 132 to inquire whether system mode equals none. Since system mode will have been previously set equal to none in step 162, during the previous execution of the control logic, the processor will proceed along the yes path to step 134 and read the water temperature from the water temperature sensor 52 in the return line of the hydronic system. The processor will proceed to inquire as to whether the water temperature read from sensor 52 is between the range of temperatures set forth in step 136. Since the boiler will have just recently been turned off, the water temperature in the return line should be above thirty two degrees Centigrade so as to prompt the processor to proceed along the no path out of step 136 to a step 164 and inquire as to whether the changeover timer set in step 160 is equal to zero. The changeover timer will have just been set equal to a predetermined changeover time in the previous execution of the control logic. This will prompt the processor to proceed along the no path to a step 166 and decrement the changeover time previously loaded into the change over timer. It is to be appreciated that the amount of time thereby decremented will be essentially the delay time defined by step 148 between successive executions of the control logic. The processor proceeds from step 166 to step 148 wherein the delay is again implemented before the next successive execution of the control logic.

It is to be appreciated that successive executions of the control logic will occur as long as the zone controllers continue to indicate a higher percentage cooling requirement than heating requirement and that this higher percentage cooling requirement remains greater than the minimum cooling demand. At some point during the successive executions of the control logic, the processor may note in step 136 that the water temperature in the return line is within the range of the temperatures set forth in step 136. On the other hand, the processor may note that the changeover timer has been decremented to zero in step 164 before the water temperature in the return line is within range. In either case, the processor will proceed from step 136 or step 164 to step 138 and inquire as to whether the system demand equals cool. Since the system demand will have been continually set equal to cool each time step 120 is encountered, the processor will proceed to step 168 and set the two way valve 14 to a cooling position. The processor will thereafter proceed to step 170 and activate the pump 50 and deactivate the pump 48. The processor will then proceed to a step 172 and start the chiller 10. The processor will thereafter set the system mode equal to cool in a step 174. The processor will proceed to send the system mode setting of "cooling' to the zone controllers 24, 30, and 34. Each zone controller will use the communicated setting to determine how to position its control valve. In this regard, if the local demand is for cooling, then the control valve will be positioned by the zone controller so as to deliver cooled water from the chiller to the fan coil heat exchanger. If the local demand is however for heating, then the cooled water from the chiller will bypass the fan coil heat exchanger. It is to be appreciated that the above assumes that the local zone controller is not able to independently determine whether the water being delivered is hot or cold. In the event that the zone controllers possess the capability of independently determining the temperature of the water being delivered, then they will implement the positioning of their respective control valves without the need to receive the system mode setting from the system controller 44.

It is hence to be appreciated that the control logic will have implemented a changeover from heating to cooling in the event that the changeover time as defined by the changeover timer elapses or in the event that the water temperature sensor is within the predefined range of water temperatures in step 136. It is furthermore to be appreciated that the control logic can possibly implement a changeover from cooling back to heating when the percentage heating requirement exceeds the percentage cooling requirement at some point during the successive executions of control logic. At such time, the system demand will be set equal to heat in step 114 prompting the processor to proceed through steps 128, 130, 132 to step 154 to inquire whether the system mode is equal to heat. Since the system mode will still be equal to cool, the processor will proceed from step 154 along the no path to step 174 to inquire whether the system mode is equal to cool. Since system mode will still be equal to cool, the processor will proceed to a step 176 to inquire whether the cool run timer is greater than the minimum cool run time. If the cool run timer has not been sufficiently incremented so as to exceed the minimum cool run time, the processor will proceed to step 178 and increment the cool run timer before returning to step 148. The processor will again execute the aforementioned logic steps of 114, 128,130,132, 154, 174 and 176 until the cool run timer exceeds the minimum cool run time. At this point, the processor will proceed to stop the chiller 10 before setting the changeover timer equal to "T" in step 160. The processor will proceed to step 162 and set system mode equal to none and heat run timer and cool run timer equal to zero. The processor will proceed to step 148 and implement the delay before again polling the zone controllers in step 102. Assuming that the polling continues to indicate that heating requirements exceed cooling requirements, the processor will proceed though steps 110-114, 128 to step 132. Since the system mode is now equal to none, the processor will proceed to implement steps 134, 136, and steps 164-166 and then 148 until such time as the water temperature read in step 134 is within range or the changeover timer has been decremented to zero. At such time, the processor will proceed to step 138 and hence to steps 140-146 so as to change the hydronic system to a heating mode of operation.

Referring again to step 116, it is to be noted that there may a situation wherein the particular polling by the processor will indicate that there is neither a predominance of heating or cooling being required by the zone controllers. In this case, the processor will proceed to step 122 and inquire as to whether the percent cooling requirement and the percent heating requirement are both equals to zero. If this is the case, the processor proceeds to set the system demand equal to none in a step 124 prompting the processor to proceed to step 128. Depending upon the previous system mode setting, the processor will proceed through either step 154 or step 174 in order to stop the operating equipment and set the system mode equal to none. The processor will proceed through step 148 before again implementing the aforementioned logic as long as the polling requirements remain unchanged.

Referring again to step 122, in the event that the percent cooling requirement and percent heating requirement do not equal zero, the processor will proceed to step 128. Since the system requirements and system mode will be whatever was previously determined, the processor will proceed to step 130 where it will then proceed along the yes path and increment the appropriate run timer for whatever mode it is currently in.

It is to be appreciated that the control logic of FIG. 2 allows the system controller 44 to potentially initiate a changeover from either heating to cooling or vice versa in response to the polling of the zone controllers 24,30, and 34. This changeover will actually occur only when certain requirements are met. Specifically, the boiler or chiller must have been running for a minimum time. Secondly, the water temperature must be within the predefined temperature range or the changeover timer must have expired indicating that the change over time has been exceeded. It is only after such events have occurred that the system controller will authorize the repositioning of the two-way valve 14 and activation of the appropriate pumps 48 or 50 as well as the starting of the heating source or cooling source.

It is to be appreciated that a preferred embodiment of the invention has been disclosed. Alterations or modifications may occur to one of ordinary skill in the art. For instance, the control logic may be altered so as to not require a sensing of water temperature in the return line. In this case, the changeover time would be the governing factor as to whether a changeover would be allowed to occur.

It will be appreciated by those skilled in the art that further changes could be made to the above-described invention without departing from the scope of the invention. Accordingly, the foregoing description is by way of example only and the invention is to be limited only by the following claims and equivalents thereto.

What is claimed is:

1. A control system for controlling a hydronic system having both a heating source capable of heating water to be delivered over a piping line to a plurality of heat exchangers and a cooling source capable of cooling water to be delivered over the same piping line to the plurality of heat exchangers, said control system comprising:

a plurality of zone controllers, each zone controller connected to a respective heat exchanger so as to control the delivery of water over the piping line to the respective heat exchanger, each zone controller being operative to generate a demand signal corresponding to a request for one of heated water, cooled water or no water;

a hydronic temperature sensor disposed in the piping line and configured to generate a sensed water temperature; and a hydronic system controller in communication with each of said zone controllers and operatively coupled to the hydronic temperature sensor, said hydronic system controller being operative to periodically receive the demand signal from each zone controller determine whether a predominance of the demand signals are requests for heating or cooling, and to activate, only if the sensed water temperature of the circulating water is within a predefined temperature range, either the heating source when a predominance of demand signals are for heating or the cooling source when the predominance of demand signals are for cooling.

2. The control system of claim 1 wherein the piping line includes a return section fluidly communicating from outlets of each heat exchanger to inlets of the heating source and cooling source, and in which the temperature sensor is disposed in the piping line return section.

3. The control system of claim 1 in which at least one of the heating source and cooling source is a currently active source while the other of the heating source and cooling source is a currently inactive source, in which the hydronic system controller is operative to deactivate the currently active source in response to a predominance of demand signals requesting operation of the currently inactive source, and in which the hydronic system controller is further operative to activate the currently inactive source only after a predetermined period of time has elapsed.

4. The control system of claim 3 wherein said hydronic system controller is further operative to activate the currently inactive source before the predetermined period of time has elapsed if the sensed water temperature is within a predefined temperature range.

5. The control system of claim 4 wherein the piping line includes a return section fluidly communicating from outlets of each heat exchanger to inlets of the heating source and cooling source, and in which the temperature sensor is disposed in the piping line return section.

6. The control system of claim 1, in which at least one of the heating source and cooling source is a currently active source while the other of the heating source and cooling source is a currently inactive source, and wherein said hydronic system controller is operative to deactivate the currently active source if a predetermined run time has elapsed for the currently active source.

7. The control system of claim 3 wherein said hydronic system controller is operative to periodically determine whether all zone controllers are demanding no conditioned water, said hydronic system controller being operative to thereafter maintain the currently active source in an active state and to furthermore transmit a message to the zone controllers indicating that the currently active source will continue to provide water over the pipe line to the heat exchangers controlled by the zone controllers.

8. The control system of claim 1 wherein said hydronic system controller is operative to send a message to each of the zone controllers indicating whether heated water or cooled water is to be provided to the heat exchangers and wherein each of said zone controllers is operative to control the delivery of water to the associated heat exchanger depending on whether the zone controller demand signal corresponds to a request for heated water, cooled water or no water.

9. A hydronic system for use in a space having multiple zones, the hydronic system comprising:

a heat exchanger disposed in at least three of the zones;

a heating source capable of heating water;

a cooling source capable of cooling water;

a piping line fluidly communicating between both the heating source and the cooling source and each of the heat exchangers;

a zone controller operatively coupled to each heat exchanger, each zone controller being operable to generate a demand signal in response to at least one sensed parameter in the zone associated with the zone controller, wherein the demand signal corresponds to a request for one of heated water, cooled water, or no water;

a hydronic temperature sensor disposed in the piping line and configured to generate a sensed water temperature; and a hydronic system controller operatively coupled to each zone controller and the hydronic temperature sensor, the hydronic system controller being operative to:

periodically receive the demand signal from each zone controller, determine whether a predominance of the demand signals are requests for heating or cooling, and activate, only if the sensed water temperature is within a predefined temperature range, either the heating source when the predominance of the demand signals are for heating or the cooling source when the predominance of the demand signals are for cooling.

10. The hydronic system of claim 9, in which the piping line includes a return section fluidly communicating from outlets of each heat exchanger to inlets of the heating source and cooling source, and in which the temperature sensor is disposed in the piping line return section.

11. The hydronic system of claim 9, in which at least one of the heating source and cooling source is a currently active source while the other of the heating source and cooling source is a currently inactive source, in which the hydronic system controller is operative to deactivate the currently active source in response to a predominance of demand signals requesting operation of the currently inactive source, and in which the hydronic system controller is further operative to activate the currently inactive source only after a predetermined period of time has elapsed.

12. The hydronic system of claim 11, in which the hydronic controller is further operative to activate the currently inactive source before the predetermined period of time has elapsed if the sensed water temperature is within a predefined temperature range.

13. The hydronic system of claim 12, in which the piping line includes a return section fluidly communicating from outlets of each heat exchanger to inlets of the heating source and cooling source, and in which the temperature sensor is disposed in the piping line return section.

14. The hydronic system of claim 9, in which at least one of the heating source and cooling source is a currently active source while the other of the heating source and cooling source is a currently inactive source, and in which the hydronic system controller is operative to deactivate the currently active source if a predetermined run time has elapsed for the currently active source.

15. The hydronic system of claim 11, in which the hydronic system controller is operative to send a message to each of the zone controllers indicating whether heated water or cooled water is to be provided to the heat exchangers, and wherein each of the zone controllers is operative to control delivery of water to the associated heat exchanger depending on whether the zone controller demand signal corresponds to a request for heated water, cooled water, or no water.

* * * * *